US010357893B1

(12) United States Patent
Frolov et al.

(10) Patent No.: US 10,357,893 B1
(45) Date of Patent: Jul. 23, 2019

(54) ADJUSTABLE STOP ASSEMBLY

(71) Applicants: Robert Bosch Power Tools GmbH, Leinfelden-Echterdingen (DE); Robert Bosch GmbH, Stuttgart (DE)

(72) Inventors: Andrew Frolov, Glenview, IL (US); Timothy A. Szweda, Chicago, IL (US)

(73) Assignees: Robert Bosch Power Tools GmbH, Leinfelden-Echterdingen (DE); Robert Bosch GmbH, Stuttgart (DE)

( * ) Notice: Subject to any disclaimer, the term of this patent is extended or adjusted under 35 U.S.C. 154(b) by 1 day.

(21) Appl. No.: 15/857,201

(22) Filed: Dec. 28, 2017

(51) Int. Cl.
*B27B 27/08* (2006.01)

(52) U.S. Cl.
CPC ..... *B27B 27/08* (2013.01)

(58) Field of Classification Search
CPC ..... B27B 27/10; B27B 27/00; B27B 27/02; B27B 27/08; B27B 27/04; Y10T 83/863; Y10T 83/7593; Y10T 83/7647; Y10T 83/7722; Y10T 83/773
See application file for complete search history.

(56) References Cited

U.S. PATENT DOCUMENTS 2,325,082 A * 7/1943 Tautz ..... B23Q 3/005 83/438
3,994,484 A 11/1976 Schorr
4,658,687 A * 4/1987 Haas ..... B27B 27/02 269/238
4,805,505 A 2/1989 Cantlin
4,934,678 A * 6/1990 Bernier ..... B25B 5/08 269/303
5,063,983 A 11/1991 Barry
5,337,641 A 8/1994 Duginske
5,518,053 A 5/1996 Robison
5,617,909 A 4/1997 Duginske
5,647,258 A 7/1997 Brazell et al.
5,768,966 A 6/1998 Duginske
5,845,555 A 12/1998 Dawley
6,557,601 B1 5/2003 Taylor
2002/0050201 A1* 5/2002 Lane ..... B23D 47/025 83/477.2
2002/0108480 A1* 8/2002 Hewitt ..... B27B 27/02 83/446
2004/0107812 A1* 6/2004 Yu ..... B27B 27/02 83/438

* cited by examiner

*Primary Examiner* — Jennifer B Swinney
(74) *Attorney, Agent, or Firm* — Kathy K. Takeguchi; Maginot Moore & Beck LLP

(57) ABSTRACT

An adjustable stop assembly includes a body, a cam, a lock knob, an adjustable rod, and an adjusting knob. The cam is movable into a locked position in which the hook portion is secured to a rail and an unlocked position in which the hook portion is spaced from the rail. The lock knob is configured to interact with the cam. The adjustable rod extends outward from a first side of the body by a first extension amount and a second side of the body by a second extension amount. The adjusting knob is configured to move the adjustable rod to adjust the first extension amount and the second extension amount. A minor sector portion of the adjusting knob is exposed by an opening in the body while a major sector portion of the adjusting knob is covered by the body at a given instance.

14 Claims, 10 Drawing Sheets

ADJUSTABLE STOP ASSEMBLY

FIELD OF THE INVENTION

This disclosure relates generally to adjustable stop assemblies.

BACKGROUND

In general, various devices, such as jigs and stop blocks, provide users with the ability to define dimensions of cuts for workpieces. Once these various devices are set-up and in position, users can make repeated cuts for workpieces at these defined dimensions (e.g., widths, lengths, or the like). However, these various devices may possess several drawbacks, such as being inconvenient to set up, incapable of fine adjustments, etc.

SUMMARY

The following is a summary of certain embodiments described in detail below. The described aspects are presented merely to provide the reader with a brief summary of these certain embodiments and the description of these aspects is not intended to limit the scope of this disclosure. Indeed, this disclosure may encompass a variety of aspects that may not be explicitly set forth below.

In an example embodiment, an adjustable stop assembly includes a body, a cam, a lock knob, an adjustable rod, and an adjusting knob. The cam includes a hook portion. The cam is movable into a locked position in which the hook portion is secured to a rail portion of the rail and an unlocked position in which the hook portion is spaced from the rail. The lock knob is configured to interact with the cam to provide a locked state in which the cam is in the locked position and an unlocked state in which the cam is in the unlocked position. The adjustable rod extends outward from a first side of the body by a first extension amount and a second side of the body by a second extension amount. The adjusting knob is configured to move the adjustable rod to adjust the first extension amount and the second extension amount. The adjusting knob is disposed within the body such that a minor sector portion of the adjusting knob is exposed by an opening in the body and a major sector portion of the adjusting knob is covered by the body at a given instance.

In an example embodiment, a power tool system includes a power tool, a work surface with a rail, and an adjustable stop assembly. The adjustable stop assembly includes at least a body, a cam, a lock knob, an adjustable rod, and an adjusting knob. The cam includes a hook portion. The cam is movable into a locked position in which the hook portion is secured to a rail portion of the rail and an unlocked position in which the hook portion is spaced from the rail. The lock knob is configured to interact with the cam to provide a locked state in which the cam is in the locked position and an unlocked state in which the cam is in the unlocked position. The adjustable rod extends outward from a first side of the body by a first extension amount and a second side of the body by a second extension amount. The adjusting knob is configured to move the adjustable rod to adjust the first extension amount and the second extension amount. The adjusting knob is disposed within the body such that a minor sector portion of the adjusting knob is exposed by an opening in the body and a major sector portion of the adjusting knob is covered by the body at a given instance.

These and other features, aspects, and advantages of the present invention are further clarified by the following detailed description of certain exemplary embodiments in view of the accompanying drawings throughout which like characters represent like parts.

DETAILED DESCRIPTION

The embodiments described above, which have been shown and described by way of example, and many of their advantages will be understood by the foregoing description, and it will be apparent that various changes can be made in the form, construction, and arrangement of the components without departing from the disclosed subject matter or without sacrificing one or more of its advantages. Indeed, the described forms of these embodiments are merely explanatory. These embodiments are susceptible to various modifications and alternative forms, and the following claims are intended to encompass and include such changes and not be limited to the particular forms disclosed, but rather to cover all modifications, equivalents, and alternatives falling with the spirit and scope of this disclosure.

Figure 1:
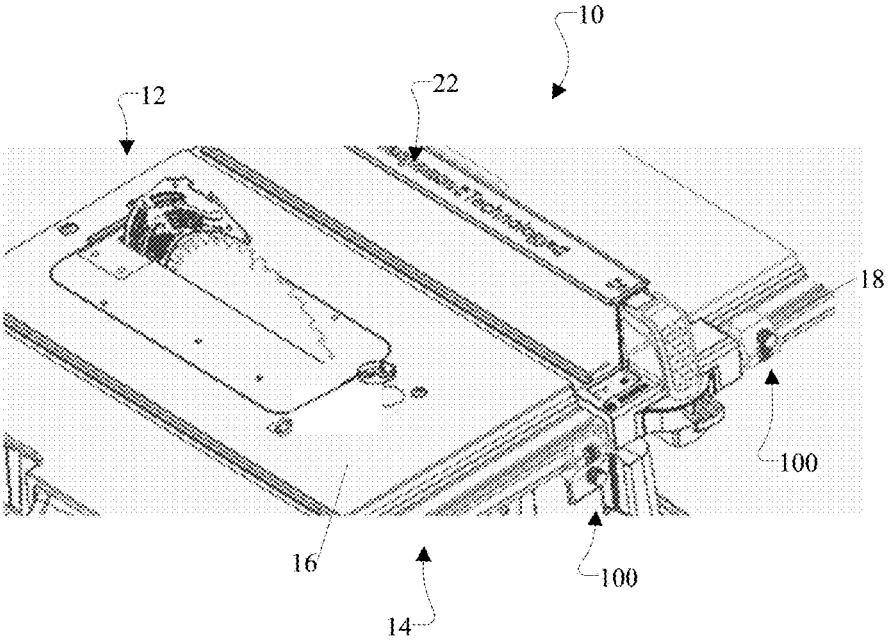
FIG. 1 is a perspective view of an example of a power tool apparatus with an adjustable stop assembly according to an example embodiment of this disclosure.

FIG. 1 is a perspective and partial view of a power tool apparatus 10. In an example embodiment, the power tool apparatus 10 can be any suitable apparatus, such as a saw apparatus, a router table, etc. In the partial view shown in FIG. 1, for instance, the power tool apparatus 10 is a table saw apparatus, which includes at least a cutting tool assembly 12, a table assembly 14, a fence assembly 22, a rail 18, and one or more adjustable stop assemblies 100. In addition, the power tool apparatus 10 can include other features that are not shown in FIG. 1.

In an example embodiment, the cutting tool assembly 12 includes at least a blade. In an example embodiment, the table assembly 14 includes at least a work surface 16 and a rail 18. In an example embodiment, the fence assembly 22 includes at least a fence 24, a carriage 26, and a locking device 28. In an example embodiment, the fence assembly 22 is movable along the rail 18, which extends along the work surface 16. In addition, the fence assembly 22 can be secured at a desired location along the rail 18. Also, in an example embodiment, the adjustable stop assembly 100 is configured to position the fence assembly 22 at the desired location along the rail 18.

Figure 2:
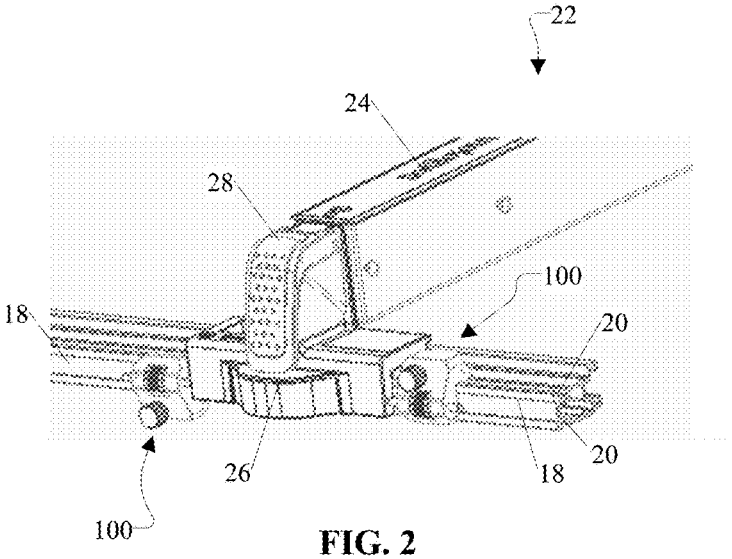
FIG. 2 is a perspective view of the adjustable stop assembly of FIG. 1 in relation to a fence assembly and a rail according to an example embodiment of this disclosure.
Figure 3:
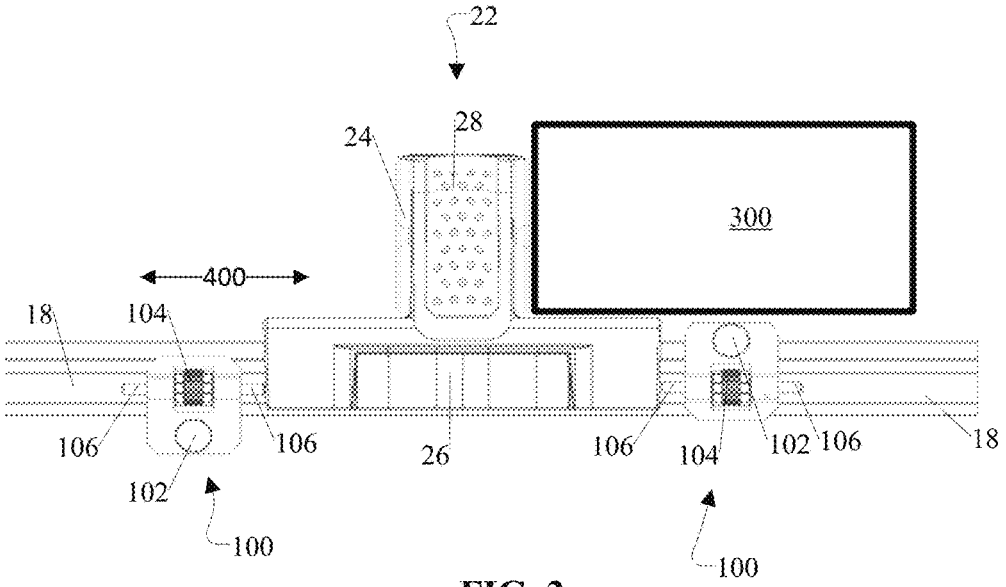
FIG. 3 is a front view of a plurality of adjustable stop assemblies in relation to a fence assembly, a rail, and a workpiece according to an example embodiment of this disclosure.
Figure 4:
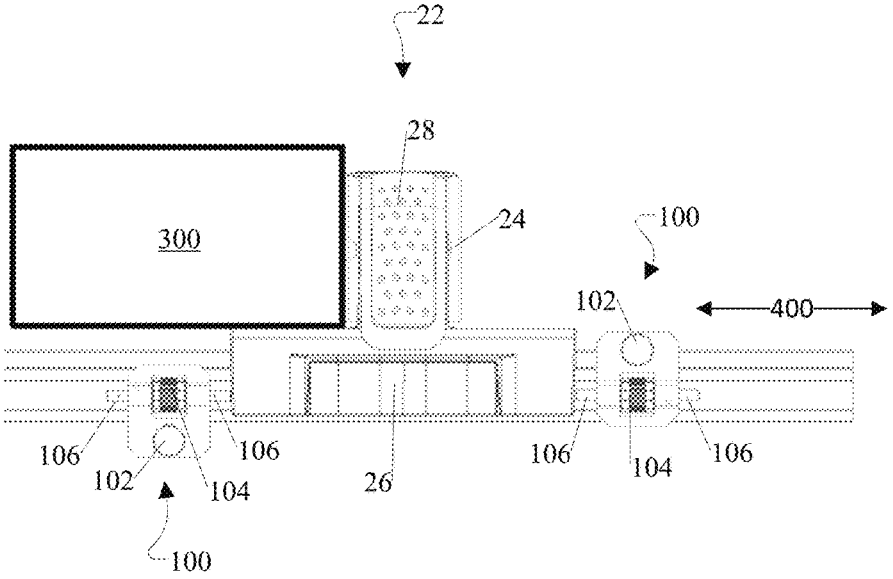
FIG. 4 is a front view of a plurality of adjustable stop assemblies in relation to a fence assembly, a rail, and a workpiece according to an example embodiment of this disclosure.

FIGS. 2-4 illustrate views of a plurality of adjustable stop assemblies 100 in relation to the fence assembly 22 and the rail 18 according to an example embodiment. In an example embodiment, as shown in FIGS. 2-4, the fence assembly 22 includes at least the fence 24, the carriage 26, and the locking device 28. In an example embodiment, the fence 24 is structured to stabilize and guide a workpiece 300 in relation to the cutting tool assembly 12. In an example embodiment, the carriage 26 is structured to carry and move the fence 24 to a desired location along the rail 18. In an example embodiment, the locking device 28 includes a locking handle or any suitable locking mechanism that is configured to provide an unlocked state in which the fence assembly 22 is movable along the rail 18 and a locked state in which the fence assembly 22 is secured to the desired location along the rail 18.

In an example embodiment, when the fence assembly 22 is in an unlocked state, the adjustable stop assembly 100 is structured such that a rotational movement of the adjusting knob 104 is converted into a linear movement of the adjustable rod 106 that is sufficient to move or adjust a position of the fence assembly 22 with a high degree of precision along the rail 18. In this regard, the adjustable stop assembly 100 is configured to provide fine adjustments on a first side of the adjustable stop assembly 100 and a second side of the adjustable stop assembly 100 via the adjustable rod 106, which is movable along an axis parallel to a first axis 400. In contrast, when the fence assembly 22 is in the locked state, the adjustable stop assembly 100 is structured such that a rotation of the adjusting knob 104 is translated into a linear movement of the adjustable rod 106 that is insufficient to move or adjust a position of the fence assembly 22 along the rail 18. In this regard, for instance, the adjustable stop assembly 100 is structured such that a reaction force from the fence assembly 22 in the locked state is greater than a linear force of the adjustable rod 106 due to the limited grip and rotational force that can be applied to the adjusting knob 104. This limited grip feature of the adjusting knob 104 is advantageous in ensuring that the fence assembly 22, when in the locked state, remains in position and aligned with, for example, a blade of the cutting tool assembly 12, thereby improving safety, for example, by preventing the workpiece 300 from being wedged between the blade and the fence assembly 22 and causing kickback.

In an example embodiment, the adjustable stop assembly 100 is structured to engage with the rail 18. More specifically, in an example embodiment, the adjustable stop assembly 100 is configured to provide a locked state and an unlocked state with respect to the rail 18. In the locked state, the adjustable stop assembly 100 is secured to a rail portion of the rail 18 and configured to serve as a stopper that prevents the fence assembly 22 from moving along the rail 18. In the unlocked state, the adjustable stop assembly 100 is movable to different positions along the rail 18.

In an example embodiment, when the rail 18 includes at least one groove 20 on an upper portion of the rail 18, the adjustable stop assembly 100 can be mounted in a first orientation, as shown on the right side of the fence assembly 22 in FIGS. 2-4. In an example embodiment, the adjustable stop assembly 100 has its locking knob 102 positioned above its adjusting knob 104 in the first orientation. Also, in an example embodiment, when the rail 18 includes at least one groove 20 on a lower portion of the rail 18, the adjustable stop assembly 100 can be mounted in a second orientation, as shown on the left side of the fence assembly 22 in FIGS. 2-4. In an example embodiment, the adjustable stop assembly 100 has its adjusting knob 104 positioned above its locking knob 102 in the second orientation. Moreover, as shown in FIGS. 3-4, the adjustable stop assembly 100 is structured such that its components (e.g., lock knob 102, adjusting knob 104, etc.) do not interfere with the workpiece 300 in the event that the workpiece 300 extends beyond the work surface 16 and overlaps the adjustable stop assembly 100. In this regard, the adjustable stop assembly 100 advantageously works with various types of workpieces 300 of various sizes. Also, the adjustable stop assembly 100 is advantageous in that workpieces 300 can be placed directly above the adjustable stop assembly 100 without interference when mounted either in the first orientation or the second orientation.

Figure 5:
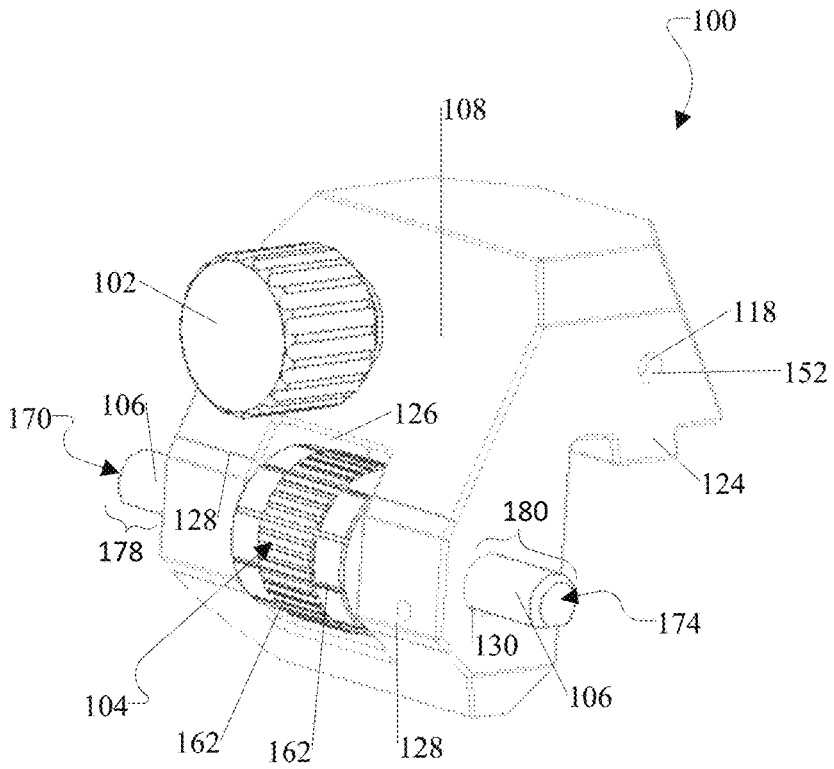
FIG. 5 is a perspective view of the adjustable stop assembly according to an example embodiment of this disclosure.
Figure 6:
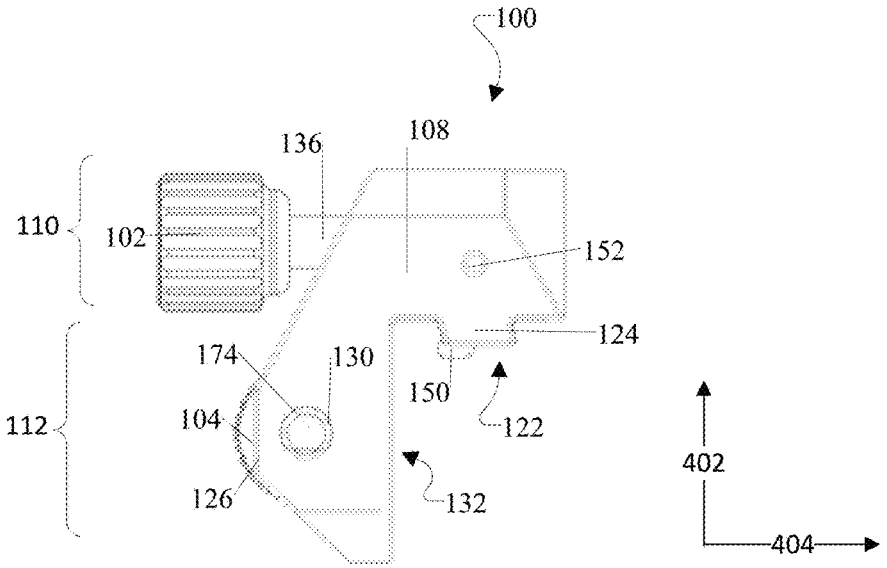
FIG. 6 is a side view of the adjustable stop assembly of FIG. 5 according to an example embodiment of this disclosure.
Figure 7:
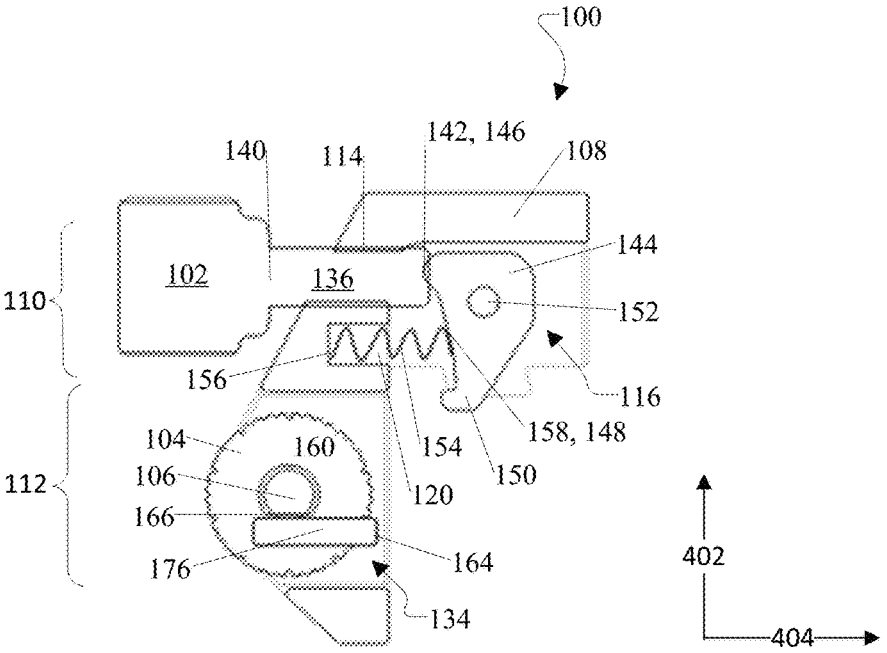
FIG. 7 is a cross-sectional view of the adjustable stop assembly of FIG. 6 according to an example embodiment of this disclosure.
Figure 8:
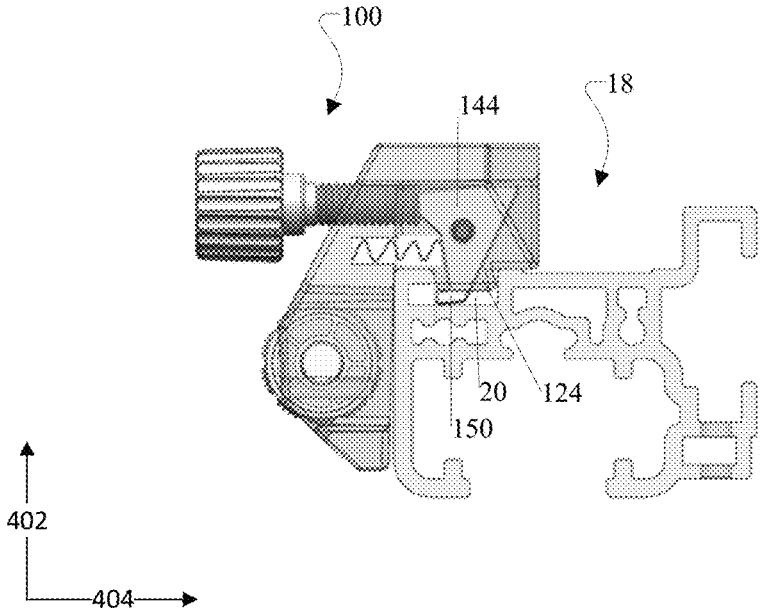
FIG. 8 is a cross-sectional view of the adjustable stop assembly of FIG. 6 in an unlocked state with respect to a rail according to an example embodiment of this disclosure.
Figure 9:
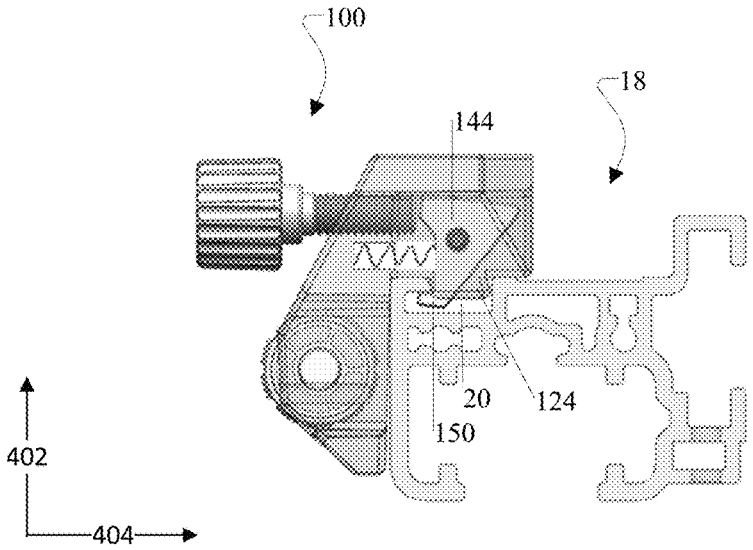
FIG. 9 is a cross-sectional view of the adjustable stop assembly of FIG. 6 in a locked state with respect to a rail according to an example embodiment of this disclosure.

FIGS. 5-9 provide different views of the adjustable stop assembly 100 according to an example embodiment. More specifically, FIG. 5 is a perspective view, FIG. 6 is a side view, and FIGS. 7-9 are cross-sectional views of the adjustable stop assembly 100. In an example embodiment, the adjustable stop assembly 100 includes at least a body 108. In an example embodiment, as shown in FIGS. 6-7, the body 108 includes at least a first portion 110 and a second portion 112. In an example embodiment, the first portion 110 includes at least a locking device. In an example embodiment, the locking device is configured to provide the adjustable stop assembly 100 with at least a locked state and an unlocked state with respect to the rail 18. In an example embodiment, the locking device includes at least the lock knob 102, the lock knob fastener 136, the cam 144, the cam axle 152, and the spring 154. Also, in an example embodiment, the second portion 112 includes an adjustment device. In an example embodiment, the adjustment device is configured to at least position or assist with the positioning of an adjacent unit (e.g., fence assembly 22) with precision and ease in a safe manner. In an example embodiment, the adjustment device includes at least an adjusting knob 104, an adjustable rod 106, and a pin 176.

In an example embodiment, the first portion 110 and the second portion 112 comprise a substantially L-shaped cross section, which is structured to embrace a corner portion of the rail 18, as shown in at least FIGS. 8-14. Also, as shown in FIG. 6, the first portion 110 includes a first inner side 122 that faces the rail 18 and the second portion 112 includes a second inner side 132 that faces the rail 18. In an example embodiment, the first inner side 122 includes at least one surface, which is structured to engage with and move along an upper/lower surface of the rail 15, and at least one protrusion 124, which is structured to engage with and move within the groove 20 of the rail 18. In an example embodiment, the second inner side 132 includes at least one surface, which is structured to engage with and move along a side surface of the rail 18. In an example embodiment, the first inner side 122 and the second inner side 132 are structured to engage closely with the rail 18 such that the adjustable stop assembly 100 is configured to move along the rail 18 when in the unlocked state and serve as a stopper along the rail 18 when in the locked state.

In an example embodiment, the first portion 110 houses at least some parts of the locking device. In this regard, for example, the first portion 110 includes a channel 114, which is structured to receive the lock knob fastener 136. The channel 114 provides sufficient clearance for the lock knob fastener 136 to move within the body 108 and engage with the cam 144. In an example embodiment, the first portion 110 includes a cam region 116, which is structured to receive the cam 144 and the cam axle 152. The cam region 116 provides sufficient clearance for the cam 144 to move relative to the cam axle 152. In addition, the first portion 110 includes cam axle connection portions 118 that enable the cam axle 152 to connect to the body 108. In FIG. 5, for example, the cam axle connection portions 118 include through holes at opposite sides of the body 108 to receive opposite end portions of the cam axle 152. Also, in an example embodiment, the first portion 110 includes a spring retainer 120, which is formed within the body 108, as shown in FIG. 7. In an example embodiment, the spring retainer 120 is parallel or substantially parallel to the channel 114. In an example embodiment, the spring retainer 120 and the channel 114 are connected to the cam region 116 to enable the spring 154 and the lock knob fastener 136 to interact with the cam 144.

In an example embodiment, the first portion 110 includes at least the protrusion 124, which is structured to fit within a groove 20 of the rail 18. For example, as shown in at least FIGS. 6-7, the protrusion 124 extends outward from the first portion of the body 108 and parallel to a second axis 402. The protrusion 124 is configured to slide within the groove 20 of the rail 18 when the locking device of the adjustable stop assembly 100 is in the unlocked state. The protrusion 124 is also structured to abut against a corresponding rail portion of the rail 18 to prevent a movement of the adjustable stop assembly 100 when the locking device of the adjustable stop assembly 100 is in the locked state.

In an example embodiment, the second portion 112 houses at least some parts of the adjustment device. In an example embodiment, the second portion 112 includes an adjusting knob region 134, as shown in FIG. 7. In an example embodiment, the second portion 112 also includes an opening 126 that limits access to the adjusting knob 104, thereby limiting an amount of force that can be applied to the adjusting knob 104 and thus the adjustable rod 106 in any given instance. For example, as shown in at least FIGS. 5-6, the opening 126 is sized such that a minor sector portion of the adjusting knob 104 is exposed and protrudes from the body 108 while a major sector portion of the adjusting knob 104 is housed and covered by the body 108. In this regard, for instance, the minor sector portion can be sized such that a gripping force from a user's finger can be applied thereto to rotate the adjusting knob 104. Also, in an example embodiment, the opening 126 is structured with minimum clearance such that sides of the adjusting knob 104 can thrust against the walls of the body 108 that define the opening 126, thereby enabling a rotational movement of the adjusting knob 104 to translate into a linear movement of the adjustable rod 106. Also, in an example embodiment, as shown in FIG. 5, the second portion 112 includes one or more reference lines 128 on portions of the body 108 adjacent to the opening 126 to indicate an amount of rotation of the adjusting knob 104 in relation to an amount of movement of the adjustable rod 106.

In an example embodiment, the second portion 112 includes adjustable rod holding portions 130, which are configured to receive the adjustable rod 106. In an example embodiment, the adjustable rod holding portions 130 include two through-holes at opposite end portions of the body 108. The adjustable rod holding portions 130 support the adjustable rod 106 in relation to the body 108. In addition, the adjustable rod holding portions 130 are structured with sufficient clearance such that the adjustable rod 106 is able to move in a linear manner and parallel to the first axis 400. In addition, the second portion 112 includes a pin region 164 for a pin 176, which is configured to prevent the adjustable rod 106 from rotating such that the adjustable rod 106 moves in a linear direction and parallel to the first axis 400.

In an example embodiment, the lock knob 102 is rotatable in a first direction and a second direction. The second direction is opposite to the first direction. In this regard, for example, when the lock knob 102 is rotated in the first direction, the lock knob 102 is configured to move the lock knob fastener 136 towards the cam 144. Alternatively, when the lock knob 102 is rotated in the second direction, the lock knob 102 is configured to move the lock knob fastener 136 away from the cam 144. As shown in at least FIGS. 6-7, for instance, the lock knob 102 resides outside of the body 108, but is attached to a lock knob fastener 136 that is housed at least partially within the channel 114 of the body 108.

In an example embodiment, the lock knob fastener 136 includes a first end portion 140 and a second end portion 142. The first end portion 140 of the lock knob fastener 136 is connected to the lock knob 102 such that a movement of the lock knob 102 moves the lock knob fastener 136. Alternatively, the lock knob fastener 136 can be integral with the lock knob 102. The second end portion 142 of the lock knob fastener 136 includes a cam contact portion, which is configured to interact with the cam 144. In this regard, for example, when the lock knob 102 is rotated in the first rotational direction, the lock knob 102 moves the lock knob fastener 136 such that the cam contact portion moves towards the cam 144. Alternatively, when the lock knob 102 is rotated in the second rotational direction, the lock knob 102 moves the lock knob fastener 136 such that the cam contact portion moves away from the cam 144. The lock knob fastener 136 is any suitable mechanical fastener, which is configured to provide the functionality discussed herein. For instance, as shown in at least FIGS. 8-9, the lock knob fastener 136 is elongated member with external threads.

In an example embodiment, the cam 144 comprises any suitable shape so long as the cam 144 is configured to provide the functionality discussed herein. For example, in FIG. 7, the cross-sectional shape of the cam 144 comprises an irregular shape with a plurality of sides that include at least a first surface portion 146 for the lock knob fastener 136, a second surface portion 148 for the spring 154, and a hook portion 150 for the rail 18. In an example embodiment, the first surface portion 146 of the cam 144 is configured to interact with the lock knob fastener 136 when the cam 144 transitions from the unlocked position to the locked position and when the cam 144 transitions from the locked position to the unlocked position. Also, in an example embodiment, the cam 144 includes a second surface portion 148 for the spring 154. In an example embodiment, the second surface portion 148 of the cam 144 is configured to interact with the spring 154 when the cam 144 transitions from the unlocked position to the locked position and when the cam 144 transitions from the locked position to the unlocked position.

In an example embodiment, the hook portion 150 is located at one end portion of the cam 144. In an example embodiment, the hook portion 150 extends beyond the cam region 116 of the body 108 such that the hook portion 150 is at least partially exposed from the body 108. In an example embodiment, the hook portion 150 extends beyond the protrusion 124. In an example embodiment, when mounted on the rail 18, the hook portion 150 is structured to reside within the groove 20 of the rail 18. In an example embodiment, when the cam 144 is in the unlocked position, the hook portion 150 is spaced from and movable along the rail 18, as shown in FIG. 8. In contrast, when the cam 144 is in the locked position, the hook portion 150 is secured to the corresponding rail portion of the rail 18, as shown in FIG. 9.

In an example embodiment, the cam axle 152 is an elongated member, which is structured to receive the cam 144 and serve as a rotational axis. In this regard, for example, the cam 144 is rotatable about the cam axle 152, which is supported by the cam axle connection portions 118 of the body 108. The cam axle 152 enables the cam 144 to rotate from the unlocked position to the locked position. Also, the cam axle 152 enables the cam 144 to rotate from the locked position to the unlocked position.

In an example embodiment, the spring 154 is a compression spring or any suitable type of elastic device. In an example embodiment, the spring 154 is disposed in the spring retainer 120 of the body 108. As shown in FIG. 7, for instance, the spring 154 has a first end portion 156 that engages with a surface of the spring retainer 120 and a second end portion 158 that interacts with the second surface portion 148 of the cam 144. In an example embodiment, the spring 154 transitions from a less compressed state to a more compressed state when the cam 144 transitions from the unlocked position to the locked position. Also, the spring 154 transitions from the more compressed state to the less compressed state when the cam 144 transitions from the locked position to the unlocked position. More specifically, upon transitioning from the more compressed state to the less compressed state, the spring 154 is configured to urge the cam 144 to transition from the locked position to the unlocked position.

In an example embodiment, the adjusting knob 104 includes an adjustable rod receiving portion 160, which enables the adjusting knob 104 to receive and engage with the adjustable rod 106. In FIG. 7, for example, the adjusting rod receiving portion 160 includes a through-hole or any suitable structure along a central axis of the adjusting knob 104 such that the adjustable rod 106 is concentric with the adjusting knob 104. In an example embodiment, a rotational movement of the adjusting knob 104 corresponds to a linear movement of the adjustable rod 106. In an example embodiment, the adjusting knob 104 can include a scale with one or more reference guides 162 (e.g., reference lines or indicators as shown in FIG. 5) to assist a user in making the desired amount of adjustments to the adjustable rod 106 via the adjusting knob 104.

In an example embodiment, as shown in FIG. 5, the adjustable rod 106 extends out from a first side of the body 108 by a first extension amount 178 and a second side of the body 108 by a second extension amount 180. In an example embodiment, the adjustable rod 106 is configured to move linearly in the first direction such that the first extension amount 178 increases and the second extension amount 180 decreases in response to a movement of the adjusting knob 104 in the first rotational direction. In this regard, when the adjusting knob 104 is rotated in a first rotational direction, then the adjusting knob 104 is configured to move the adjustable rod 106 in the first linear direction such that the first contact surface 170 moves away from the body 108 and the second contact surface 174 moves towards the body 108. Alternatively, the adjustable rod 106 is configured to move linearly in the second direction such that the first extension amount 178 decreases and the second extension amount 180 increases in response to a movement of the adjusting knob 104 in the second rotational direction. In this regard, when the adjusting knob 104 is rotated in a second rotational direction, then the adjusting knob 104 is configured to move the adjustable rod 106 in the second linear direction such that the first contact surface 170 moves towards the body 108 and the second contact surface 174 moves away from the body 108.

In an example embodiment, the adjustable rod 106 is an elongated member with external threads. In an example embodiment, the adjustable rod 106 has a D-shaped cross section, which is advantageous in that the flat side 166 of the D-shape is structured to prevent a rotational movement of the adjustable rod 106. For example, in FIG. 7, the flat side 166 of the adjustable rod 106 abuts against the pin 176 such that the adjustable rod 106 moves linearly without rotation. In an example embodiment, the adjustable rod 106 has a longitudinal axis, which is parallel to a longitudinal axis of the cam axle 152. In addition, the adjustable rod 106 includes a first contact surface 170 at a first end portion 168 of the adjustable rod 106 and a second contact surface 174 at a second end portion 172 of the adjustable rod 106. The first contact surface 170 is on a first side of the adjustable stop assembly 100 while the second contact surface 174 is on a second side of the adjustable stop assembly 100. Accordingly, the adjustable stop assembly 100 is structured to provide adjustments on a first side, a second side, or both sides of the adjustable stop assembly 100 regardless of the orientation of the adjustable stop assembly 100.

Figure 10:
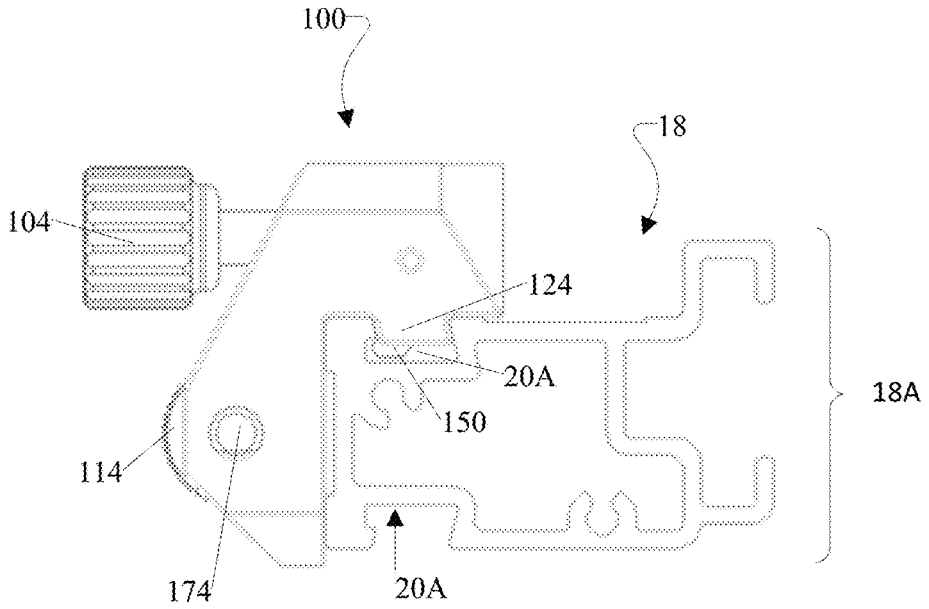
FIG. 10 is a side view of the adjustable stop assembly of FIG. 5 in a first orientation with respect to a first example of a rail profile according to an example embodiment of this disclosure.
Figure 11:
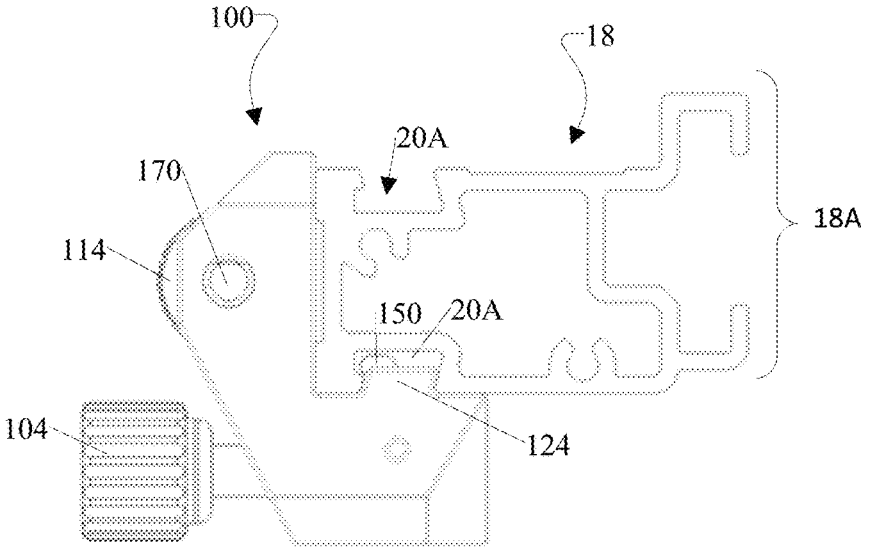
FIG. 11 is a side view of the adjustable stop assembly of FIG. 5 in a second orientation with respect to the first example of the rail profile according to an example embodiment of this disclosure.
Figure 12:
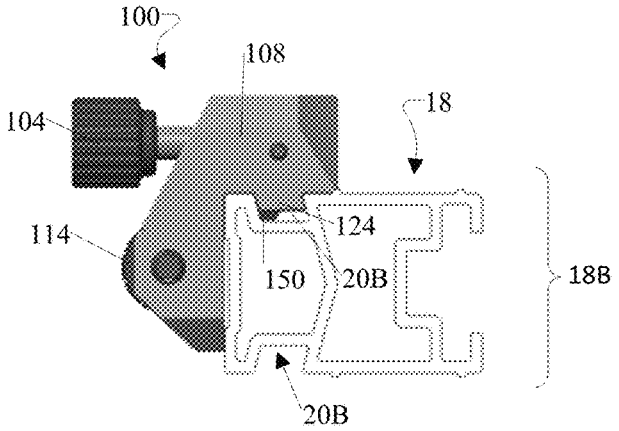
FIG. 12 is a side view of the adjustable stop assembly of FIG. 5 in relation to a second example of a rail profile according to an example embodiment of this disclosure.
Figure 13:
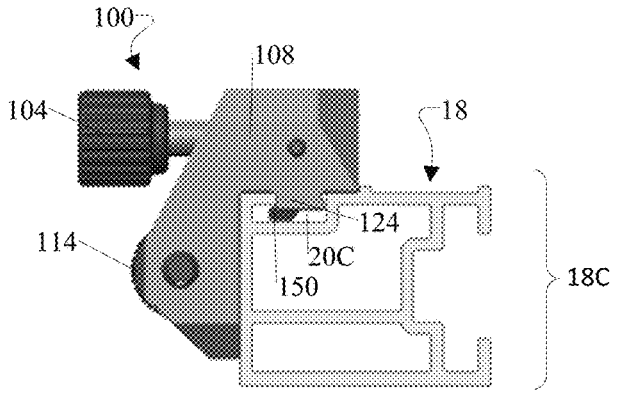
FIG. 13 is a side view of the adjustable stop assembly of FIG. 5 in relation to a third example of a rail profile according to an example embodiment of this disclosure.
Figure 14:
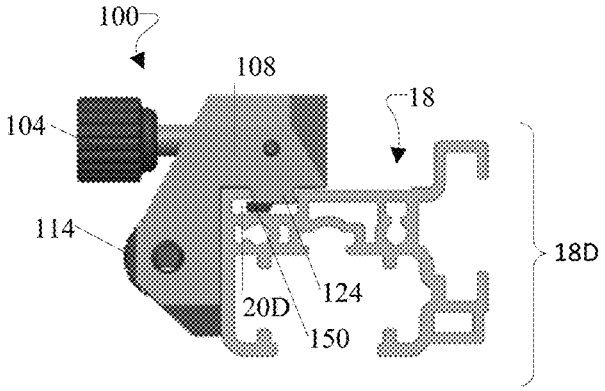
FIG. 14 is a side view of the adjustable stop assembly of FIG. 5 in relation to a fourth example of a rail profile according to an example embodiment of this disclosure.

FIGS. 10-14 illustrate side views of the adjustable stop assembly 100 in relation to various rails 18 with various profiles. As aforementioned, the adjustable stop assembly 100 is configured to engage with a groove 20, and is thus compatible with various rails 18 that include grooves 20. For example, FIGS. 10-11 illustrate a first non-limiting example of the rail 18, which has a first profile 18A that includes a groove 20A on an upper portion of the rail 18 and a groove 20A on a lower portion of the rail 18. With respect to the first profile 18A, the adjustable stop assembly 100 is structured to be mounted in a first orientation, as shown in FIG. 10, in which the protrusion 124 extends downward from the first inner side 122 to engage with the groove 20A on the upper portion of the rail 18 and the hook portion 150 interacts with the upper portion of the rail 18. In addition, with respect to the first profile 18A, the adjustable stop assembly 100 is structured to be mounted in a second orientation, as shown in FIG. 11, in which the protrusion 124 extends upward from the inner side 122 to engage with the groove 20A on the lower portion of the rail 18 and the hook portion 150 interacts with the lower portion of the rail 18. FIG. 12 illustrates a second non-limiting example of the rail 18, which has a second profile 18B that includes a groove 20B on an upper portion of the rail 18 and a groove 20B on a lower portion of the rail 18. With respect to the second profile 18B, the adjustable stop assembly 100 is structured to be mounted in a first orientation, as shown in FIG. 12, in which the protrusion 124 extends downward from an inner side 122 to engage with the groove 20A on the upper portion of the rail 18 and the hook portion 150 interacts with the upper portion of the rail 18. In addition, although not shown, with respect to the second profile 18B, the adjustable stop assembly 100 is structured to be mounted in a second orientation in which the protrusion 124 extends upward from the inner side 122 to engage with the groove 20B on the lower portion of the rail 18 and the hook portion 150 interacts with the lower portion of the rail 18. FIG. 13 illustrates a third non-limiting example of the rail 18, which has a third profile 18C that includes a groove 20C on an upper portion of the rail 18. With respect to the third profile 18C, the adjustable stop assembly 100 is structured to be mounted in a first orientation, as shown in FIG. 13, in which the protrusion 124 extends downward from the inner side 122 to engage with the groove 20A on the upper portion of the rail 18 and the hook portion 150 interacts with the upper portion of the rail 18. FIG. 14 illustrates a fourth non-limiting example of the rail 18, which has a fourth profile 18D that includes a groove 20D on the upper portion of the rail 18. With respect to the fourth profile 18D, the adjustable stop assembly 100 is structured to be mounted in a first orientation, as shown in FIG. 14, in which the protrusion 124 extends downward from the inner side 122 to engage with the groove 20A on the upper portion of the rail 18 and the hook portion 150 interacts with the upper portion of the rail 18. As demonstrated above, the adjustable stop assembly 100 is compatible with various rails 18 with grooves 20. That is, to the extent that the groove structure of the rail 18 permits, the orientation of the adjustable stop assembly 100 can be set in accordance with a user's preference.

Figure 15:
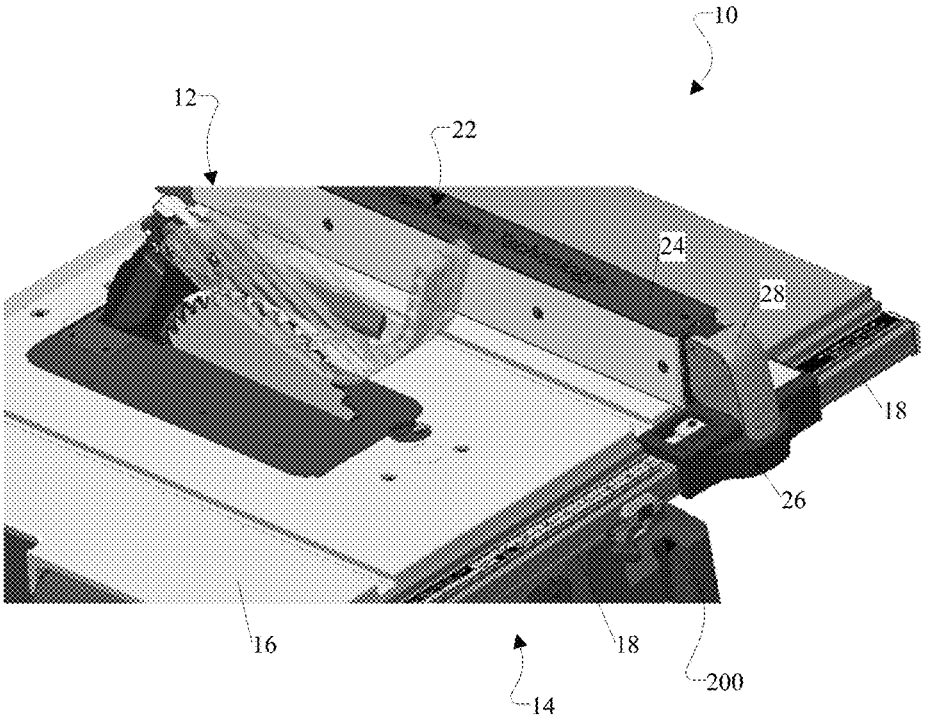
FIG. 15 is a perspective view of an example of a power tool apparatus with another example of an adjustable stop assembly according to an example embodiment of this disclosure.
Figure 16:
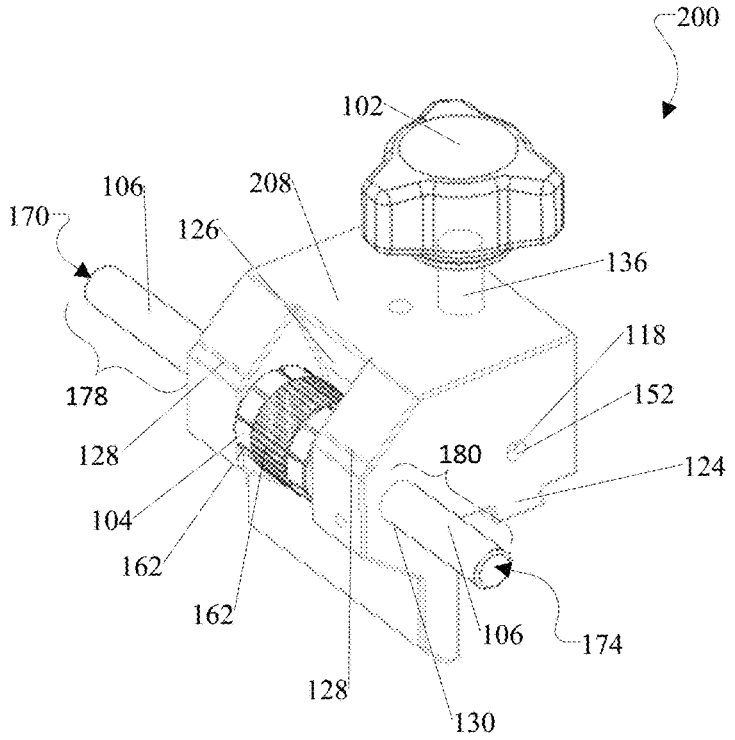
FIG. 16 is a perspective view of another example of the adjustable stop assembly according to an example embodiment of this disclosure.
Figure 17:
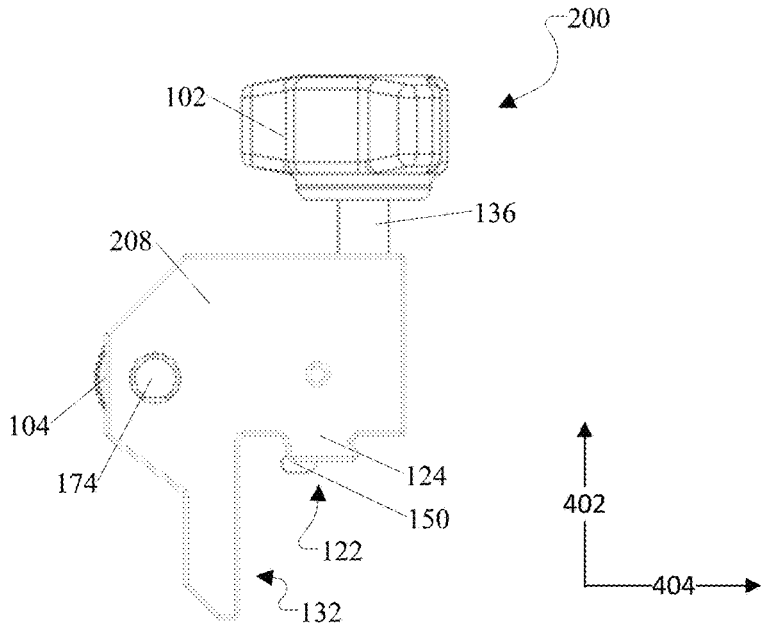
FIG. 17 is a side view of the adjustable stop assembly of FIG. 16 according to an example embodiment of this disclosure.
Figure 18:
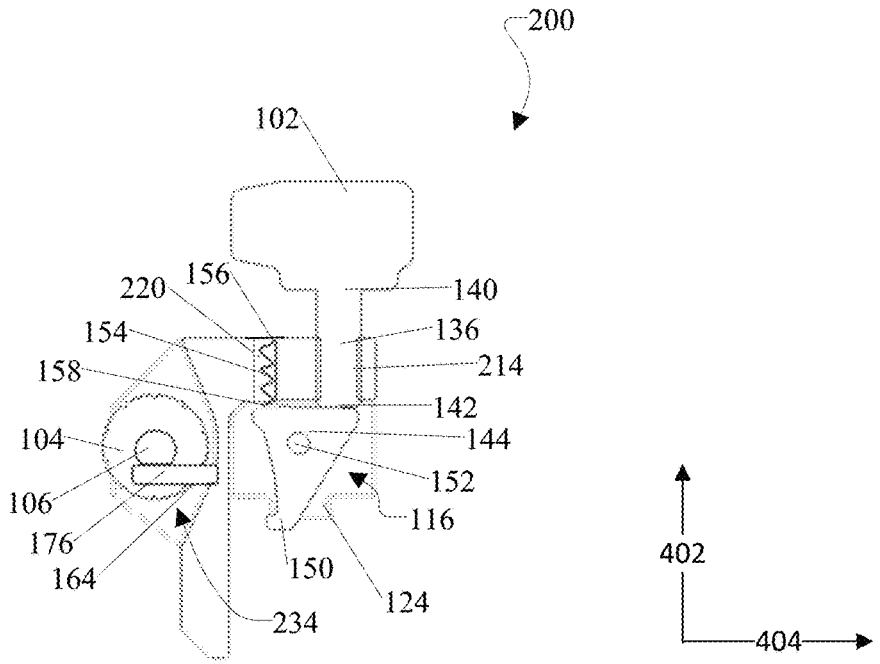
FIG. 18 is a cross-sectional view of the adjustable stop assembly of FIG. 17 according to an example embodiment of this disclosure.
Figure 19:
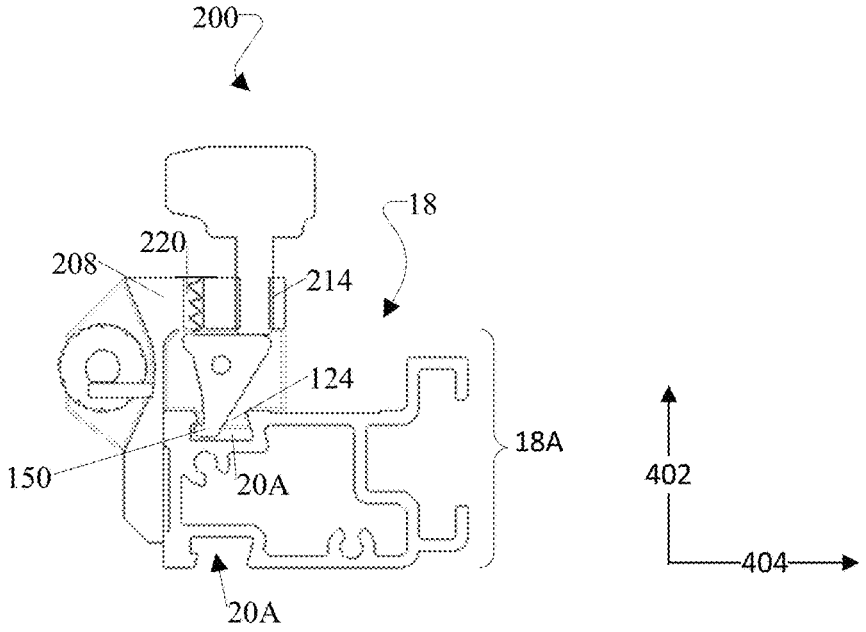
FIG. 19 is a cross-sectional view of the adjustable stop assembly of FIG. 17 in relation to the rail according to an example embodiment of this disclosure.

FIGS. 15-19 illustrate another example of an adjustable stop assembly 200 according to an example embodiment. Specifically, FIG. 15 illustrates the power tool apparatus 10 with at least one adjustable stop assembly 200. In addition, FIGS. 16-19 illustrate different views of the adjustable stop assembly 200. As shown, the adjustable stop assembly 200 (FIGS. 15-19) includes a number of similar or substantially similar features as that of the adjustable stop assembly 100 (FIGS. 1-14). The details of these similar or substantially features are discussed with respect to FIGS. 1-14 and are not repeated below. In addition, the adjustable stop assembly 200 includes a number of different or substantially different features compared to that of the adjustable stop assembly 100 (FIGS. 1-14). For example, as shown in FIGS. 15-19, the adjustable stop assembly 200 has components of its locking device oriented differently than that of the adjustable stop assembly 100 of FIGS. 1-14. More specifically, for example, the adjustable stop assembly 100 of FIGS. 1-14 has the lock knob 102, the lock knob fastener 136, and the spring 154 oriented along axes that are perpendicular to the second axis 402 and/or parallel to the third axis 404. In contrast, the adjustable stop assembly 200 of FIGS. 15-19 has the lock knob 102, the lock knob fastener 136, and the spring 154 oriented along axes that are parallel to the second axis 402 and/or perpendicular to the third axis 404. Also, as shown in FIGS. 18-19, the adjustable stop assembly 200 has a body 208 that includes a channel 214 and a spring retainer 220, which extend along axes that are parallel to the second axis 402. In this regard, the lock knob fastener 136 and the spring 154 of the adjustable stop assembly 200 are positioned to interact with different surface portions of the cam 144 than the lock knob fastener 136 and the spring 154 of FIGS. 1-14. With this configuration, the lock knob 102 of FIGS. 15-19 is accessible at a top portion of the body 208. Also, by positioning the lock knob 102 at the top portion of the body 208, the adjustable stop assembly 200 now has room to provide an adjusting knob region 234 at an upper portion of the body 208, as shown in FIG. 17. In an alternative embodiment (not shown), the adjustable knob region 234 of the body 208 can be located within a similar or substantially similar region as that of adjusting knob region 134 of the body 108 (FIGS. 1-14). Furthermore, compared to the adjustable stop assembly 100 of FIGS. 1-14, the adjustable stop assembly 200 of FIGS. 15-19 occupies less space along axes parallel to the third axis 404 since the lock knob 102 and lock knob fastener 136 extend along axes parallel to the second axis 402. In addition, the adjustable stop assembly 200 of FIGS. 15-19 provides more distinct spacing between the lock knob 102 and the adjusting knob 104 compared to that of the adjustable stop assembly 100 of FIGS. 1-14.

As described above, the adjustable stop assembly 100/200 provides a number of advantageous features, as well as benefits. For example, the adjustable stop assembly 100/200 is configured to improve the accuracy of cuts by enabling fine adjustments or microadjustments to be made, for example, to a fence assembly 22 and enabling repeatability of measurements of the same sizes. Also, the adjustable stop assembly 100/200 is configured to mount directly on the rail 18 and move to a desired location along the rail 18 with ease. The adjustable stop assembly 100/200 can be placed on any side of the fence assembly 22 as the adjustable stop assembly 100/200 is configured to provide fine adjustments or microadjustments on either side of the adjustable stop assembly 100/200. In addition, the adjustable stop assembly 100/200 is structured such that fine adjustments or microadjustments can be made to the fence assembly 22 only if the fence assembly 22 is unlocked, thereby providing a measure of safety. The adjustable stop assembly 100/200 also provides a limited grip surface of the adjusting knob 104 via the opening 126 in the body 108, thereby limiting applied forces to the adjustable rod 106 and preventing the fence assembly 22, when locked, from being moved out of alignment. In addition, the adjustable stop assembly 100/200 can be mounted on the rail 18 in a first orientation or a second orientation. This feature enables the adjustable stop assembly 100 to be oriented in accordance with a user's preference. Also, the adjustable stop assembly 100/200 is structured to provide sufficient clearance such that a workpiece 300 can be placed directly above the adjustable stop assembly 100/200 without having its components (e.g., lock knob 102) interfere with the workpiece 300. In addition, the adjustable stop assembly 100/200 is configured to prevent the fence assembly 22 from being pushed out of alignment, thereby preventing kick-back and improving the safety of the power tool apparatus 10.

That is, the above description is intended to be illustrative, and not restrictive, and provided in the context of a particular application and its requirements. Those skilled in the art can appreciate from the foregoing description that the present invention may be implemented in a variety of forms, and that the various embodiments may be implemented alone or in combination. Therefore, while the embodiments of the present invention have been described in connection with particular examples thereof, the general principles defined herein may be applied to other embodiments and applications without departing from the spirit and scope of the described embodiments, and the true scope of the embodiments and/or methods of the present invention are not limited to the embodiments shown and described, since various modifications will become apparent upon a study of the drawings, specification, and following claims. For example, components and functionality may be separated or combined differently than in the manner of the various described embodiments, and may be described using different terminology. These and other variations, modifications, additions, and improvements may fall within the scope of the disclosure as defined in the claims that follow.

What is claimed is:

1. An adjustable stop assembly comprising:

a body;

a cam with a hook portion that extends outward from the body, the cam being movable into a locked position in which the hook portion is secured to a rail portion of a rail and an unlocked position in which the hook portion is spaced from the rail;

a lock knob configured to interact with the cam to provide a locked state in which the cam is in the locked position and an unlocked state in which the cam is in the unlocked position;

an adjustable rod extending outward from a first side of the body by a first extension amount and a second side of the body by a second extension amount; and an adjusting knob configured to move the adjustable rod to adjust the first extension amount and the second extension amount, the adjusting knob being disposed within the body such that a minor sector portion of the adjusting knob is exposed by an opening in the body and a major sector portion of the adjusting knob is covered by the body at a given instance.

2. The adjustable stop assembly of claim 1, wherein the adjusting knob is configured to move the adjustable rod in (a) a first direction such that the first extension amount is increased and the second extension amount is decreased and (b) a second direction such that the first extension amount is decreased and the second extension amount is increased.

3. The adjustable stop assembly of claim 1, further comprising:

a spring configured to interact with the cam, the spring being configured to transition the cam from the locked position to the unlocked position as the spring transitions from a more compressed state to a less compressed state.

4. The adjustable stop assembly of claim 1, further comprising:

a body protrusion that protrudes from the body, the body protrusion being structured to engage with a groove of the rail such that the body protrusion is configured to move within the groove of the rail when the adjustable stop assembly is in the unlocked state.

5. The adjustable stop assembly of claim 1, further comprising:

a pin to prevent a rotational movement of the adjustable rod, wherein the adjustable rod includes a D-shaped cross-section with a flat side that abuts against the pin such that the adjustable rod moves linearly in response to the rotational movement of the adjusting knob.

6. The adjustable stop assembly of claim 1, wherein:

the adjustable rod includes threads, and the adjusting knob engages with the threads of the adjustable rod and moves the adjustable rod in accordance with a rotational movement of the adjusting knob.

7. A power tool system comprising:

a power tool;

a work surface with a rail; and an adjustable stop assembly including (a) a body;

(b) a cam with a hook portion that extends outward from the body, the cam being movable into a locked position in which the hook portion is secured to a rail portion of the rail and an unlocked position in which the hook portion is spaced from the rail;

(c) a lock knob configured to interact with the cam to provide a locked state in which the cam is in the locked position and an unlocked state in which the cam is in the unlocked position;

(d) an adjustable rod extending outward from a first side of the body by a first extension amount and a second side of the body by a second extension amount; and (e) an adjusting knob configured to move the adjustable rod to adjust the first extension amount and the second extension amount, the adjusting knob being disposed within the body such that a minor sector portion of the adjusting knob is exposed by an opening in the body and a major sector portion of the adjusting knob is covered by the body at a given instance.

8. The power tool system of claim 7, wherein:

the rail includes a first groove on an upper portion of the rail and a second groove on a lower portion of the rail; and the adjustable stop assembly is configured to be mounted in a first orientation when engaged with the first groove and a second orientation when engaged with the second groove, the first orientation being opposite to the second orientation.

9. The power tool system of claim 7, further comprising:

a fence assembly configured to be in a locked state in which the fence assembly is secured to the rail and an unlocked state in which the fence assembly is movable along the rail, wherein the adjustable rod is configured to adjust a position of the fence assembly along the rail when the fence assembly is in the unlocked state.

10. The power tool system of claim 7, wherein the adjusting knob is configured to move the adjustable rod in (a) a first direction such that the first extension amount is increased and the second extension amount is decreased and (b) a second direction such that the first extension amount is decreased and the second extension amount is increased.

11. The power tool system of claim 7, further comprising:

a spring configured to interact with the cam, the spring being configured to transition the cam from the locked position to the unlocked position as the spring transitions from a more compressed state to a less compressed state.

12. The power tool system of claim 7, further comprising:

a body protrusion that protrudes from the body, the body protrusion being structured to engage with a groove of the rail such that the body protrusion is configured to move within the groove of the rail when the adjustable stop assembly is in the unlocked state.

13. The power tool system of claim 7, further comprising:

a pin to prevent a rotational movement of the adjustable rod, wherein the adjustable rod includes a D-shaped cross-section with a flat side that abuts against the pin such that the adjustable rod moves linearly in response to the rotational movement of the adjusting knob.

14. The power tool system of claim 7, wherein:

the adjustable rod includes threads, and the adjusting knob engages with the threads of the adjustable rod and moves the adjustable rod in accordance with a rotational movement of the adjusting knob.

* * * * *